US011511315B2

(12) United States Patent
Saku

(10) Patent No.: US 11,511,315 B2
(45) Date of Patent: Nov. 29, 2022

(54) LIQUID EJECTION DEVICE, IMPRINT APPARATUS, AND EXAMINATION METHOD

(71) Applicant: CANON KABUSHIKI KAISHA, Tokyo (JP)

(72) Inventor: Tomonobu Saku, Tochigi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/112,138

(22) Filed: Dec. 4, 2020

(65) Prior Publication Data

US 2021/0178424 A1 Jun. 17, 2021

(30) Foreign Application Priority Data

Dec. 11, 2019 (JP) ..... JP2019-223774

(51) Int. Cl.

| | |
|---|---|
| ***B41J 2/165*** | (2006.01) |
| ***B05D 1/26*** | (2006.01) |
| ***B41J 2/045*** | (2006.01) |
| ***B05D 3/06*** | (2006.01) |
| ***B05C 5/00*** | (2006.01) |

(52) U.S. Cl.

CPC ..... *B05D 1/26* (2013.01); *B05C 5/00* (2013.01); *B05D 3/06* (2013.01); *B41J 2/04501* (2013.01); *B41J 2/16579* (2013.01)

(58) Field of Classification Search

CPC ..... B41J 2/16579; B41J 2/2142

See application file for complete search history.

(56) References Cited

U.S. PATENT DOCUMENTS

| | | | | |
|---|---|---|---|---|
| 10,350,631 | B2 | 7/2019 | Tamura et al. | |
| 2010/0091063 | A1* | 4/2010 | Nagata | B41J 2/16579 356/440 |
| 2020/0016899 | A1* | 1/2020 | Ogasahara | B41J 2/16523 |
| 2020/0180325 | A1* | 6/2020 | Hauf | B41J 3/28 |

FOREIGN PATENT DOCUMENTS

JP 2017-092462 A 5/2017

* cited by examiner

*Primary Examiner* — Scott A Richmond
(74) *Attorney, Agent, or Firm* — Venable LLP

(57) ABSTRACT

A liquid ejection device includes: a liquid ejection unit with an ejection port surface provided with an ejection port from which liquid is ejected and configured to eject the liquid onto a substrate at an ejection position; an image capturing mechanism configured to face the ejection port surface of the liquid ejection unit and to capture an image of the ejection port surface at a maintenance position different from the ejection position; and a lighting unit configured to irradiate the ejection port surface at multiple incidence angles with respect to the ejection port surface in an operation of capturing an image of the ejection port surface by the image capturing mechanism.

23 Claims, 4 Drawing Sheets

LIQUID EJECTION DEVICE, IMPRINT APPARATUS, AND EXAMINATION METHOD

BACKGROUND OF THE INVENTION

Field of the Invention

The present invention relates to a liquid ejection device, an imprint apparatus, and an examination method.

Description of the Related Art

There has been known a technique of observing and examining an ejection unit of a liquid ejection device. Japanese Patent Laid-Open No. 2017-92462 (hereinafter, referred to as PTL 1) discloses that an image of an ejection port surface including an ejection port is captured by an image capturing device, and the captured image is used to detect an abnormality in the ejection port or the ejection port surface.

However, the technique disclosed in PTL 1 is not able to examine an abnormality in an ejection unit including a liquid circulation path and the ejection port surface.

SUMMARY OF THE INVENTION

A liquid ejection device according to an aspect of the present invention, includes: a liquid ejection unit configured with an ejection port surface provided with an ejection port from which liquid is ejected and configured to eject the liquid onto a substrate at an ejection position; an image capturing mechanism configured to face the ejection port surface of the liquid ejection unit and to capture an image of the ejection port surface at a maintenance position different from the ejection position; and a lighting unit configured to irradiate the ejection port surface at a plurality of incidence angles with respect to the ejection port surface in an operation of capturing an image of the ejection port surface by the image capturing mechanism.

Further features of the present invention will become apparent from the following description of exemplary embodiments with reference to the attached drawings.

DESCRIPTION OF THE EMBODIMENTS

Figure 1:
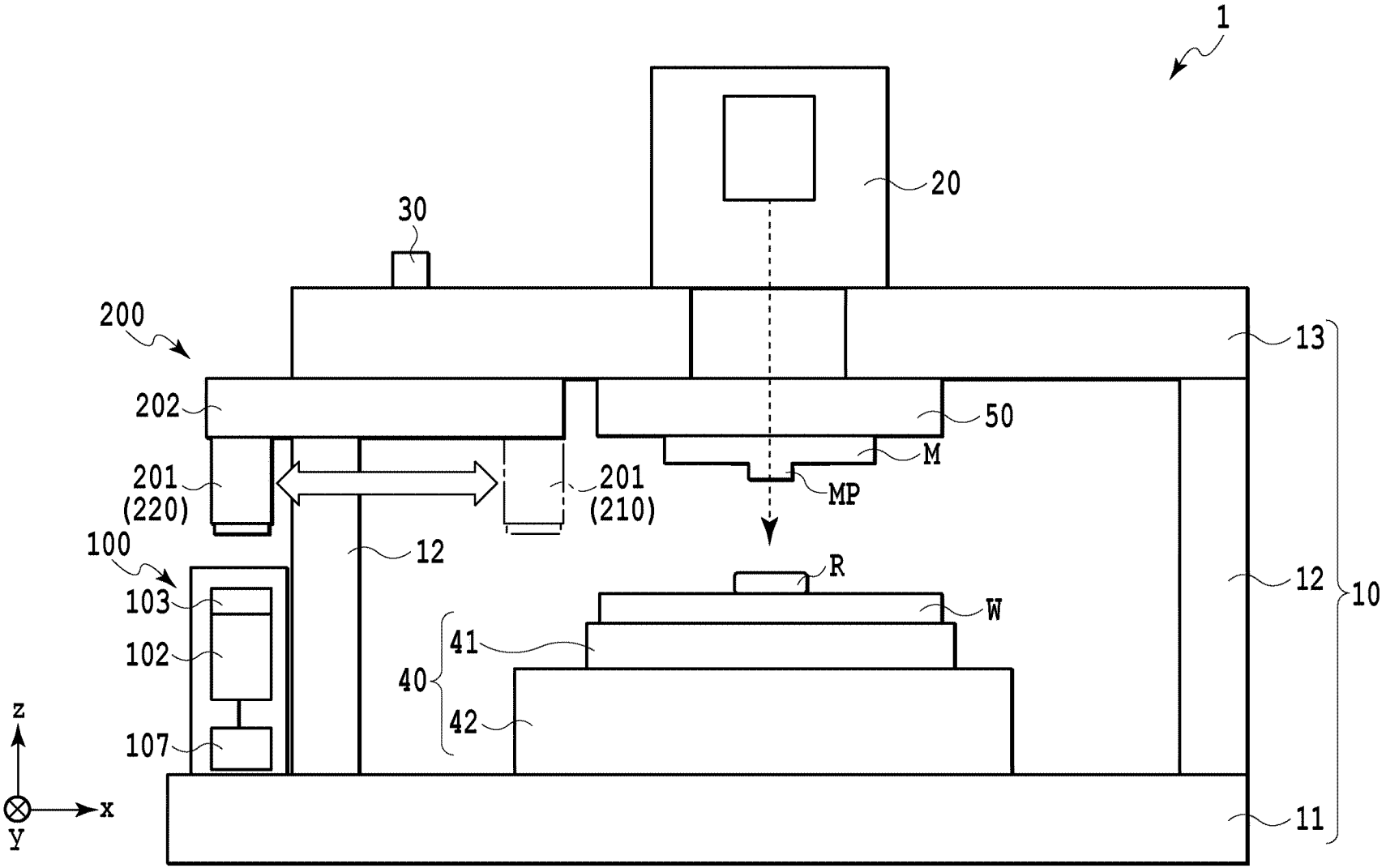
FIG. 1 is a schematic diagram illustrating a configuration of an imprint apparatus.

Hereinafter, favorable embodiments of the present invention are described in detail with reference to the accompanying drawings. The same configurations are described with the same reference numerals assigned thereto. The relative arrangements, shapes, and so on described in the embodiments are merely examples.

First Embodiment

In this embodiment, here is described an example of applying an examination mechanism for a liquid ejection unit to an imprint apparatus including a liquid ejection device. Note that, the examination mechanism for the liquid ejection unit can be applied to any devices that supply an object with liquid. For example, the examination mechanism for the liquid ejection unit described in this embodiment may be applied to a three-dimensional printer or another processing apparatus.

FIG. 1 is a schematic diagram illustrating a configuration of an imprint apparatus 1. In FIG. 1, an axis in a vertical direction is a Z-axis, and two axes orthogonal to each other in a plane perpendicular to the Z-axis are an X-axis and a Y-axis.

The imprint apparatus 1 includes a liquid ejection device 200, and an ejection port (see 206 in FIG. 2) of the liquid ejection device 200 applies a liquid imprint material R (also referred to as resin, resist, or ejection material) onto a substrate W. The inkjet system is used for the liquid ejection device 200 to eject liquid (liquid droplets) from a liquid ejection unit 201 provided with multiple ejection ports.

The imprint apparatus 1 is a lithography apparatus used in a manufacturing process of a semiconductor device and the like. The imprint apparatus 1 causes the liquid ejection device 200 to form the imprint material R on the substrate W and causes the imprint material R to form a circuit pattern MP of a mold M on the substrate W. In this embodiment, the imprint apparatus 1 uses resin as the imprint material R and adopts a photo-curing method as a photo-curing method of curing the resin by irradiation with ultraviolet rays (UV light).

The imprint apparatus 1 may include the mold M, the substrate W, the imprint material R, a main body structure 10, an exposure light source 20, a control unit 30, a substrate driving unit 40, a mold driving unit 50, and not-illustrated mold conveyance system and substrate conveyance system. The control unit 30 controls units of the imprint apparatus 1.

The mold M is made of a material such as quartz that allows the ultraviolet rays to pass therethrough. The fine circuit pattern MP to be transferred onto the substrate W is formed on a surface of the mold M facing a surface on the substrate W to which the imprint material R is applied.

The main body structure 10 includes a base surface plate 11 disposed on a floor surface, a not-illustrated anti-vibration mechanism for preventing vibrations from the floor surface through the base surface plate 11, a pillar 12 including the anti-vibration mechanism, and a bridge surface plate 13 supported by the pillar 12.

The exposure light source 20 cures the imprint material R on the substrate W by irradiating the imprint material R on the substrate W with light (ultraviolet rays) through the mold M during the imprint processing. The exposure light source 20 may include, for example, a light source that emits light to cure the imprint material R and an optical system that forms the light emitted from the light source into exposure light suitable for the imprint processing.

The substrate driving unit 40 includes a substrate chuck 41 and a substrate stage 42. The substrate chuck 41 holds the substrate W made of, for example, single crystal silicon, by vacuum suction or electrostatic force. The substrate stage 42 drives the substrate W and the substrate chuck 41 in a plane direction parallel to a surface of the substrate W on which the imprint processing is performed, which is an X-direction and a Y-direction.

The substrate stage 42 includes a tilt driving mechanism that drives in tilt directions in which rotations about the X-direction and the Y-direction are made, a driving system that drives in a Z-direction orthogonal to the substrate W, and a driving system that drives in a θ-direction about the Z-axis.

The mold driving unit 50 can drive the mold M in the Z-direction orthogonal to the imprint surface of the substrate W and in the tilt directions in which the rotations about the X-direction and the Y-direction are made, while holding the mold M.

With the imprint operation performed by driving the mold driving unit 50, the circuit pattern MP of the mold M is physically brought into contact with the substrate W, and thus the circuit pattern MP is transferred onto the imprint material R on the substrate W. The driving during the imprint operation by the mold driving unit 50 may be replaced with the driving by the Z-axis driving system and the tilt driving mechanism of the substrate stage 42.

The liquid ejection device 200 is a device that supplies the substrate W with liquid. Specifically, the liquid ejection device 200 ejects the liquid imprint material R onto the substrate W. The liquid ejection device 200 includes a liquid ejection unit 201 that ejects the imprint material R and a driving unit 202 that drives the liquid ejection unit 201 to multiple positions.

The multiple positions of the liquid ejection unit 201 include, for example, an ejection unit first position 210 and an ejection unit second position 220. The ejection unit first position 210 is an ejection position at which the liquid ejection unit 201 ejects the liquid onto the substrate W. The ejection unit second position 220 is a maintenance position that is used for maintenance of the liquid ejection unit 201 or replacement of the liquid ejection device 200.

An examination mechanism 100 that examines the liquid ejection unit 201 is arranged so as to be positioned below in the ejection direction (vertical direction) of the liquid ejection unit 201 in a case where the liquid ejection unit 201 is moved to the ejection unit second position 220. The examination mechanism 100 is arranged at a position away from the liquid ejection unit 201. The examination mechanism 100 may include an image capturing mechanism 102 that obtains an image of the liquid ejection unit 201, a lighting unit 103 that is used for capturing image, and an image processing unit 107 that processes the image obtained by the image capturing mechanism 102.

Figure 2:
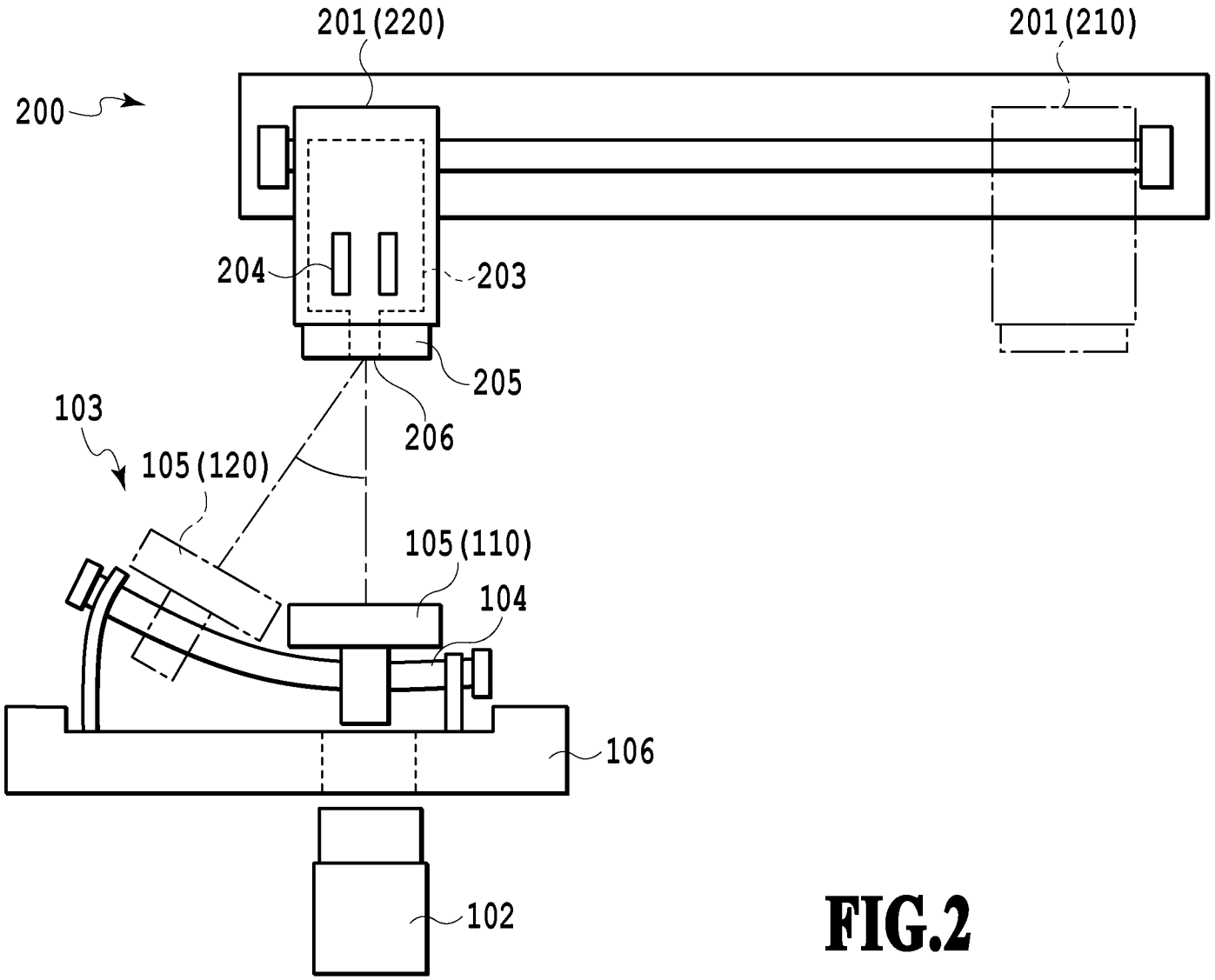
FIG. 2 is a diagram illustrating details of a liquid ejection device.

FIG. 2 is a diagram illustrating details of the liquid ejection device 200. The liquid ejection unit 201 includes a liquid circulation channel 203, a liquid ejection mechanism 204, and an ejection port surface 205. The ejection port surface 205 is provided with a small opening for the liquid ejection (ejection port 206). On the ejection port surface 205, multiple ejection ports 206 are arranged at predetermined intervals, and multiple ejection port rows including the multiple ejection ports 206 are arranged. The ejection port surface 205 is formed of a substance of relatively high transparency such as, for example, a polyimide film. In this embodiment, a piezoelectric element is used as the liquid ejection mechanism 204.

The liquid ejection device 200 supplies the piezoelectric element arranged in the ejection port 206 of the liquid ejection unit 201 with a driving pulse corresponding to a liquid ejection pattern and ejects the liquid (imprint material R) by deforming the piezoelectric element. Many liquid droplets corresponding to the pattern to be formed are ejected from the multiple ejection ports 206 onto the substrate W, and thus a desired dot pattern is formed on the substrate. Since the liquid ejection unit 201 is not in contact with the substrate W in the dot pattern formation, it is possible to perform stable imprinting without defacing the substrate W.

In this case, during the dot pattern formation or standby, a foreign substance or a liquid droplet may be attached near the opening of the ejection port 206. Otherwise, air bubbles may be mixed into the liquid. In this case, there may occur a defect such as defective ejection or quality degradation. Additionally, due to the abnormality in the liquid ejection device 200, the ejection liquid may leak out, and once the liquid droplet attached near the opening of the ejection port 206 is put in contact with the substrate W, the substrate W may be contaminated. Moreover, if the liquid keeps leaking out, the gas-liquid exchange where the gas outside the ejection port surface 205 enters the inside of the liquid ejection unit 201 through the ejection port 206 to which no liquid droplet is attached occurs. Consequently, the liquid is discharged from the ejection port 206 by the volume of the gas entered. There may be a case that the gas-liquid exchange spreads the contamination of the substrate W. Hence, in this embodiment, the liquid ejection unit 201 is observed and examined by the examination mechanism 100 to detect an abnormality in the liquid ejection unit 201.

Next, details of the examination mechanism 100 are described. The lighting unit 103 includes a dark-bright field switching mechanism 104 and a lighting 105. The dark-bright field switching mechanism 104 is an adjustment mechanism capable of moving the lighting 105 as a lighting light source to multiple positions. For example, the dark-bright field switching mechanism 104 includes a guiding mechanism that guides the position of the lighting 105 to set difference incidence angles with respect to the ejection port surface 205 of the liquid ejection unit 201. It is possible to arrange the lighting 105 in the multiple positions by moving the position of the lighting 105 along the guiding mechanism. The multiple positions include a first position 110 and a second position 120. The first position 110 is a position at which the lighting 105 is arranged immediately below in the vertical direction of the liquid ejection unit 201 moved in the ejection unit second position 220. The second position 120 is a position that is rotated and driven by about 30° about the liquid ejection unit 201 from the first position 110.

It is possible to use an LED as the lighting light source for the lighting 105. It is favorable to select a wavelength that does not cause a curing reaction of the imprint material R. For example, an LED with a wavelength of 500 nm or greater may be favorably used for the lighting light source in the imprint apparatus 1 of this embodiment. The lighting 105 may be provided with a not-illustrated dimmer mechanism to change the amount of light from the lighting light source. For example, a member for dimming the light may be provided in order to maintain the illuminance and the illuminance distribution of the light emitted to the liquid ejection unit 201 constant. Use of the dimmer mechanism makes it possible to clearly and stably capture images of the ejection port surface 205 of the liquid ejection unit 201 and the liquid circulation channel 203 inside the liquid ejection unit 201.

A tray 106 supports the dark-bright field switching mechanism 104 from below in the vertical direction. The image capturing mechanism 102 is arranged below the tray 106 in the vertical direction. The image capturing mechanism 102 is configured to be able to capture an image of the ejection port surface 205, with a portion of the tray 106 facing the image capturing mechanism 102 being provided with an opening or a transparent port. The image capturing mechanism 102 and the lighting 105 are arranged at positions deviated in the Y-direction in order to prevent the lighting 105 from being included in the angle of field of the image capturing mechanism 102 in a case where the lighting 105 is positioned at the first position 110. For example, a configuration of overlapping the lighting with the light axis of the image capturing mechanism by a beam splitter or the like may be applied. The lighting 105 may have a ring shape and be arranged to be coaxial with the image capturing mechanism 102. In a case where the ring-shape lighting is used, it is a dark field. An aperture or a shading slit may be used for the lighting. The shading slit is a member that prevents the light from passing through the center of the light axis. In a case where the shading slit is used, it is the dark field, and in a case where the shading slit is not used, it is a bright field. Usually, the bright field is lighting that passes through the center of the light axis, and the dark field is lighting that does not pass through the center of the light axis. The bright field in this embodiment may not be the lighting that passes through the center of the light axis and may be any lighting at least the lighting passes through closer to the center of the light axis than the dark field does. Hence, the bright field may refer to a case of using a ring lighting with small diameter, and the dark field may refer to a case of using a ring lighting with big diameter.

In a case where the lighting 105 is positioned at the first position 110, the lighting light source is arranged substantially perpendicular to the ejection port surface 205. Hence, in a case where the image capturing is performed by the image capturing mechanism 102 while the lighting 105 is positioned at the first position 110, the observation is performed in a brighter field than that of a case where the lighting 105 is positioned at the second position 120 (bright field observation mainly with specular reflection light). On the other hand, in a case where the image capturing is performed by the image capturing mechanism 102 while the lighting 105 is positioned at the second position 120, the lighting light source irradiates the ejection port surface 205 at an angle. Hence, the observation is performed in a darker field than that of a case where the lighting 105 is positioned at the first position 110 (dark field observation mainly with diffused reflection light).

With an image of the ejection port surface 205 captured while the lighting 105 is positioned at the first position 110 (bright field observation), an image of the liquid circulation channel 203 is captured with light passing through the polyimide film. Thus, it is possible to observe the inside of the liquid circulation channel 203 and examine a defect. The defect that occurs in the liquid circulation channel 203 of the liquid ejection unit 201 may be the entering of a particle or the air.

Figure 3A:
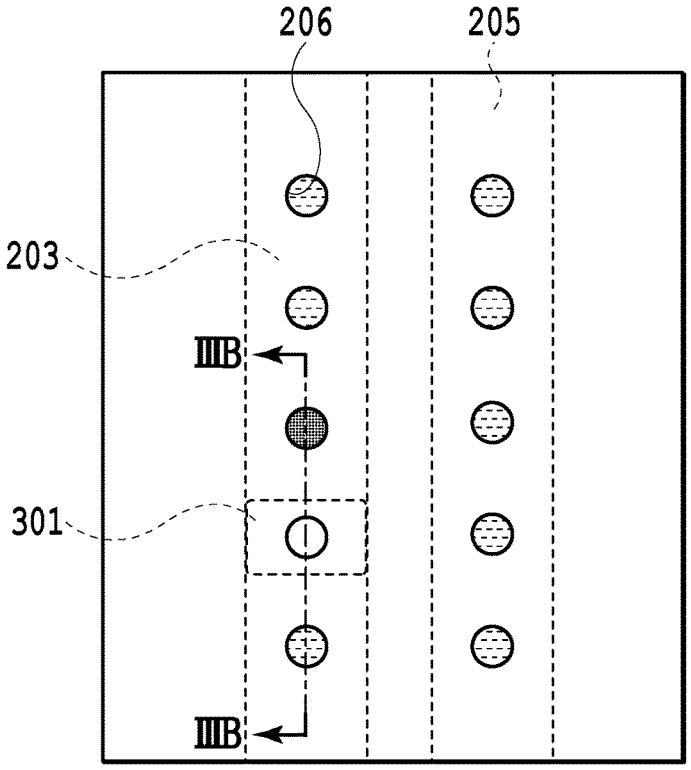
FIGS. 3A to 3D are diagrams describing a defect in a liquid ejection unit.
Figure 3B:
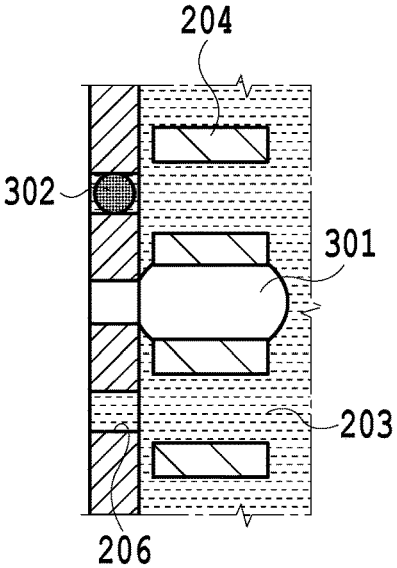

FIGS. 3A to 3D are diagrams describing the defect in the liquid ejection unit 201. FIG. 3A is a front view of the ejection port surface 205. FIG. 3A is a diagram representing an image captured by the image capturing mechanism 102 in a case where a particle or the air enters the liquid circulation channel 203. It is possible to detect the defect in the liquid circulation channel 203 based on the difference in refractive index between a part where the liquid circulates and others. FIG. 3B is a diagram illustrating a cross-section along IIIB-IIIB in FIG. 3A. As illustrated in FIGS. 3A and 3B, in a case where air 301 enters the liquid circulation channel 203, the part where the air 301 enters appears as a bright region in the captured image. On the other hand, in a case where a foreign substance 302 (particle) enters the liquid circulation channel 203, the part where the foreign substance 302 enters appears as a dark region in the captured image. Thus, it is possible to examine whether there is a defect in the liquid circulation channel 203 based on the difference in the refractive index (bright and dark regions) between the part where the liquid circulates and others.

The image processing unit 107 can detect an abnormality in the liquid circulation channel 203 by detecting the local variation in contrast as described above. The image processing unit 107 includes a storage medium and holds an ideal image of having no defects that is captured in advance. The image processing unit 107 performs image processing on a difference between the captured image and the ideal image and thus is able to determine whether it is normal or abnormal. For example, the image processing unit 107 holds respective ideal images for the case where the lighting 105 is positioned at the first position 110 and the case where the lighting 105 is positioned at the second position 120 and thus is able to perform the examination using an ideal image corresponding to the position of the lighting 105 and the captured image.

In a case where the occurrence of a defect such as the entering of the air 301 or the foreign substance 302 is detected, a not-illustrated liquid pumping unit that pumps the liquid to the liquid circulation channel 203 applies a pressure equal to or greater than usual to the liquid. This makes it possible to forcibly discharge the foreign substance such as the air from the liquid circulation channel 203 with the liquid and clean the inside of the liquid circulation channel 203.

Figure 3C:
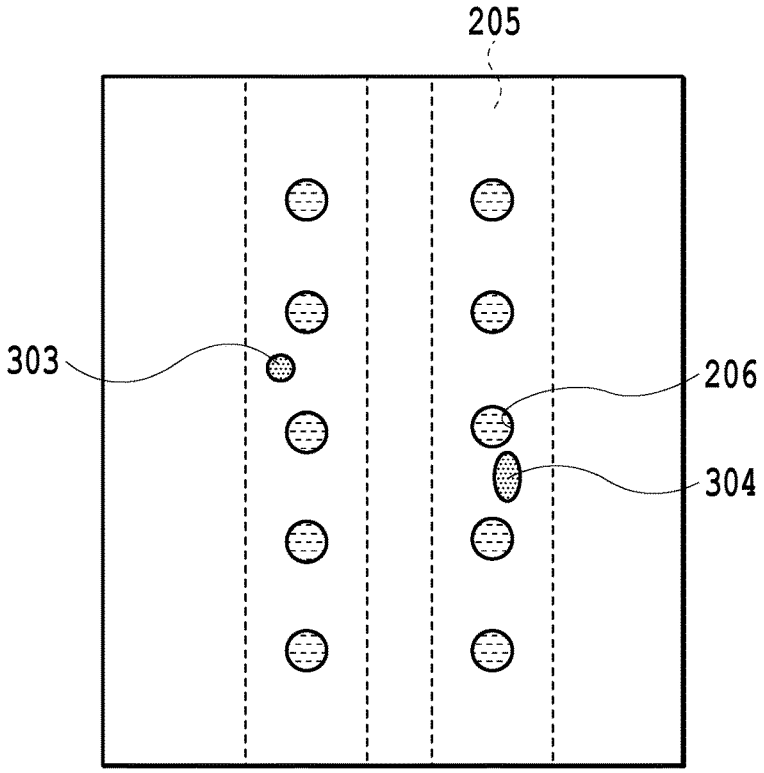
Figure 3D:
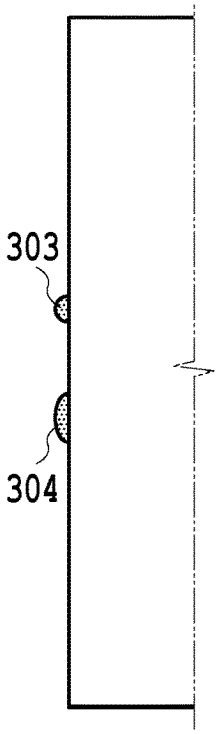

FIG. 3C is a diagram representing an image captured by the image capturing mechanism 102 while the lighting 105 is positioned at the second position 120 (dark field observation). FIG. 3C shows that a foreign substance 303 or a leaking droplet 304 is attached on the ejection port surface 205. FIG. 3D is a side view of FIG. 3C. In a case where the lighting 105 is positioned at the second position 120 (dark field observation), it is possible to examine a defect in the ejection port surface 205. In specific, as illustrated in FIGS. 3C and 3D, the image capturing is performed with the image capturing mechanism 102 receiving the diffusion light or the reflection light from the foreign substance 303 or the leaking droplet 304 attached on the surface of the polyimide film. The leaking droplet 304 indicates the leaking of the liquid out of the small ejection port 206 of the ejection port surface 205 to the polyimide film of the ejection port surface 205. Since the foreign substance 303 and the leaking droplet have the refractive indexes similar to that of polyimide, it is difficult to observe them by the image capturing with specular reflection light.

In a case where a defect such as the attachment of the foreign substance 303 or the attachment of the leaking droplet 304 as illustrated in FIGS. 3C and 3D occur, a cleaning operation is performed. For example, cleaning such as vacuuming the foreign substance 303 and the leaking droplet 304 attached on the ejection port surface 205 by a vacuum mechanism of a not-illustrated cleaning mechanism or wiping of the foreign substance 303 and the leaking droplet 304 by unwoven cloth is performed.

Thus, in this embodiment, it is possible to examine a defect in the liquid circulation channel 203 of the liquid ejection unit 201 and a defect in the ejection port surface 205 by changing the position of the lighting light source to multiple positions. Consequently, it is possible to properly perform the examination of the liquid ejection unit 201, and it is possible to maintain the good state of the liquid ejection unit 201 by executing maintenance once a defect is detected.

Figures 4A, 4B:
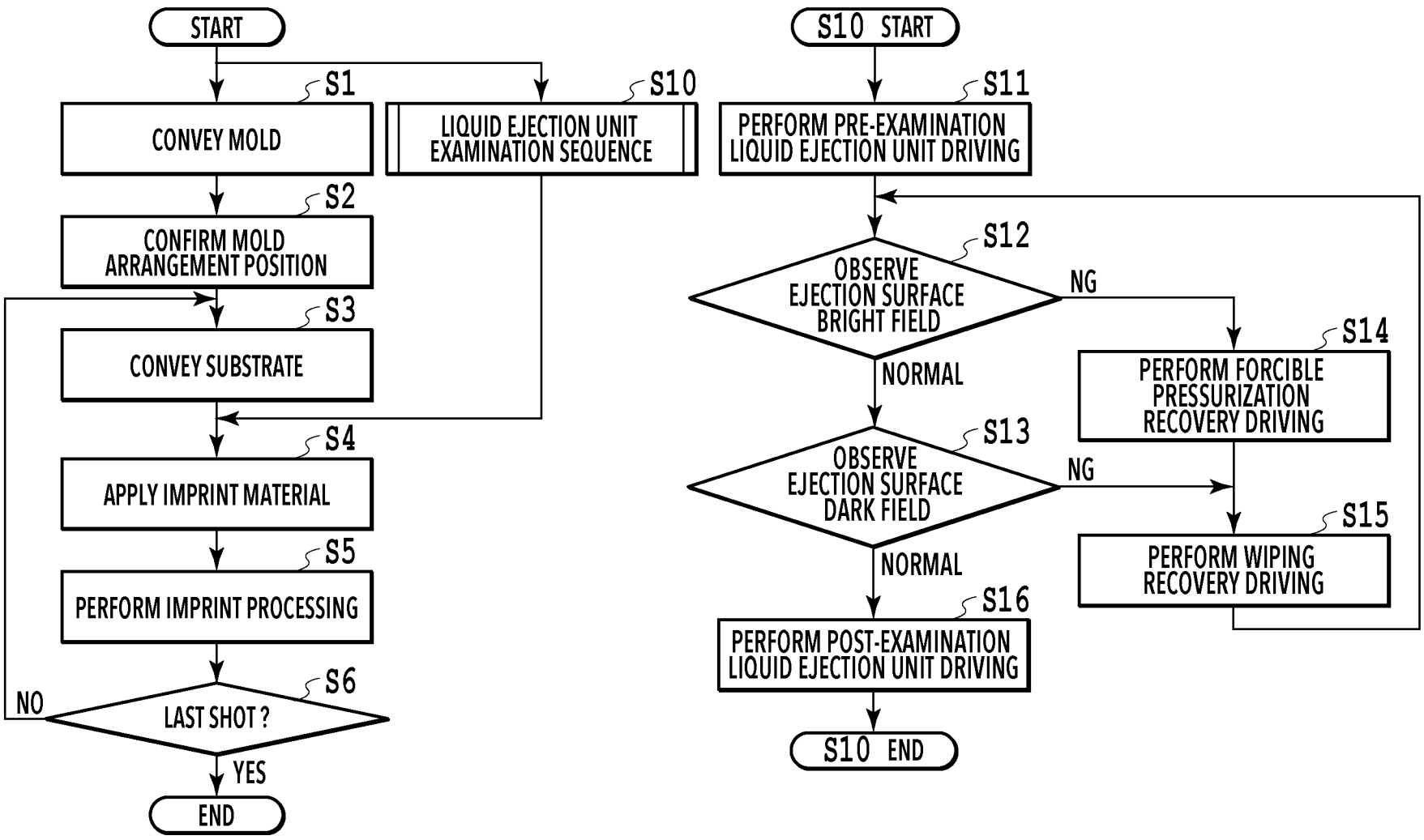
FIGS. 4A and 4B are flowcharts indicating a procedure of an imprint step.

FIGS. 4A and 4B are flowcharts indicating a procedure of the imprint steps of this embodiment. The flowcharts of FIGS. 4A and 4B are executed under a control of the control unit 30. FIG. 4A indicates the overall procedure, while FIG. 4B indicates details of a liquid ejection unit examination sequence (S10) described later.

In S1, the not-illustrated mold conveyance mechanism conveys the mold M from outside of the imprint apparatus 1 into the imprint apparatus 1. Thereafter, in S2, the mold conveyance mechanism conveys the mold M to the mold driving unit 50, and a not-illustrated mold arrangement position confirmation mechanism confirms the position at which the mold M is arranged.

In S3, the not-illustrated substrate conveyance mechanism conveys the substrate W from outside the imprint apparatus 1 into the imprint apparatus 1. Thereafter, the substrate conveyance mechanism confirms the position at which the substrate W is arranged and then conveys the substrate W to the substrate chuck 41. The order of the conveyance of the mold M and the substrate W may be opposite. Concurrently with these conveyance steps or before or after these conveyance steps, the liquid ejection unit examination sequence is executed in S10. It is favorable to complete the liquid ejection unit examination sequence before an imprint material applying step described later.

The liquid ejection unit examination sequence in S10 is described with reference to FIG. 4B. In S11, the control unit 30 executes pre-examination liquid ejection unit driving processing. Specifically, the control unit 30 drives the driving unit 202 and moves the liquid ejection unit 201 for the examination. In specific, the control unit 30 moves the liquid ejection unit 201 from the ejection unit first position 210 at which the imprint material R is ejected onto the ejection substrate W to the ejection unit second position 220 at which the examination mechanism 100 examines the liquid ejection unit 201. In a case where the liquid ejection unit 201 is already positioned at the ejection unit second position 220, S11 may be skipped.

Next, in S12, the control unit 30 executes ejection port surface bright field observation processing. In S12, the control unit 30 uses the dark-bright field switching mechanism 104 to move the lighting 105 to the first position 110 (bright field observation). In a case where the lighting 105 is already in the bright field observation state where the lighting 105 is positioned at the first position 110, the moving step is skipped. While the lighting 105 is positioned at the first position 110, the examination of the inside of the liquid circulation channel 203 in the liquid ejection unit 201 is executed. In other words, the image capturing mechanism 102 captures an image in the bright field observation. The thus-captured image is examined by the image processing unit 107. As a result of the examination in S12, if it is normal, the process proceeds to S13, and if it is abnormal, the process proceeds to S14.

In S14, the control unit 30 executes forcible pressurization recovery driving processing. The forcible pressurization recovery driving processing is executed in a case where the image processing unit 107 detects a defect in the image captured by the image capturing mechanism 102 in the bright field observation. For example, the forcible pressurization recovery driving processing is executed in a case where the image processing unit 107 detects the entering of the air 301 or the foreign substance 302 as illustrated in FIGS. 3A and 3B. As described above, the control unit 30 causes the not-illustrated liquid pumping unit that pumps the liquid to the liquid circulation channel 203 to apply a pressure equal to or greater than usual to the liquid circulation channel 203, and thereby the recovery processing for cleaning the inside of the liquid circulation channel 203 is executed. Once the processing of S14 is terminated, the process proceeds to S15.

In S15, the control unit 30 executes wiping recovery driving processing. In the wiping recovery driving processing, as described above, the operation such as wiping of the ejection port surface 205 by not-illustrated unwoven cloth or the like or vacuuming of the liquid on the ejection port surface 205 is performed. Since the recovery processing of forcibly discharging the liquid is executed in S14, a liquid droplet or the like may possibly be attached on the ejection port surface 205 in S15. Hence, the wiping recovery driving processing is executed in S15. After S15, the process returns to S12.

Next, processing for a case where it is determined that it is normal in the ejection port surface bright field observation processing in S12 is described. In S13, the control unit 30 executes ejection surface dark field observation processing. In the ejection surface dark field observation processing, the control unit 30 uses the dark-bright field switching mechanism 104 to move the lighting 105 to the second position 120 (dark field observation). While the lighting 105 is positioned at the second position 120, the examination of the ejection port surface 205 of the liquid ejection unit 201 is executed. In other words, the image capturing mechanism 102 captures an image in the dark field observation. The thus-captured image is examined by the image processing unit 107. As a result of the examination in S13, if it is normal, the process proceeds to S16, and if it is abnormal, the process proceeds to S15. If it is abnormal as a result of the ejection surface dark field observation processing, it means that there is a defect in the ejection port surface 205, as described above. For example, the foreign substance 303 or the leaking droplet 304 is attached on the ejection port surface 205 as illustrated in FIGS. 3C and 3D. Hence, the wiping recovery driving processing is executed in S15.

In S16, the control unit 30 executes post-examination liquid ejection unit driving processing. S16 is, as described above, processing for a case where the image processing unit 107 determines that it is normal in the ejection surface bright field observation (S12) and the ejection surface dark field observation (S13). In specific, since the liquid ejection unit 201 is in the normal state, the driving unit 202 is used to move the liquid ejection unit 201 to the ejection unit first position 210 at which the imprint material R is ejected onto the substrate W. Through the above process, the liquid ejection unit examination sequence of S10 is terminated. Thereafter, the process proceeds to S4.

In S4, the control unit 30 executes imprint material applying processing. In the imprint material applying processing, the liquid ejection device 200 ejects the imprint material R onto a region of the substrate W as a target of the imprint processing. Since the imprint apparatus 1 of this embodiment executes the imprint processing onto multiple regions of the substrate W, the same number of times of the imprint material applying processing are executed.

In S5, the control unit 30 executes the imprint processing. In the imprint processing, the mold M provided with the circuit pattern MP is imprinted onto the substrate W to which the imprint material R is already applied. The exposure light source 20 then irradiates the imprint material R with the light (ultraviolet rays) to cure the imprint material R and also performs processing of removing the mold M from the imprint material R.

In this embodiment, multiple shots are performed on a single substrate W. For example, the substrate W is moved in the X-direction, and the imprint material applying processing and the imprint processing for one row are executed. Thereafter, the substrate W is moved in the Y-direction (S3). The substrate W is then moved in the X-direction again, and the imprint material applying processing (S4) and the imprint processing (S5) for one row are executed. This processing is executed repeatedly until the imprint apparatus 1 determines that it is a last shot. Once the imprint processing for the last shot is executed, the substrate W is conveyed outside the imprint apparatus, and the imprint step for a single substrate is terminated.

Although there is described an example of executing the liquid ejection unit examination sequence (S10) during the conveyance of the substrate W and the mold M into the imprint apparatus 1 in this embodiment, the configuration is not limited thereto. For example, the liquid ejection unit examination sequence (S10) may be executed at a timing when a shot for one row of the substrate W is completed. Otherwise, the liquid ejection unit examination sequence (S10) may be executed appropriately according to an indication by an operator.

As described above, according to this embodiment, the position of the lighting light source with respect to the liquid ejection unit is switched to the multiple positions. Additionally, as the examination is performed with the image capturing mechanism 102 capturing an image of the ejection port surface 205 of the liquid ejection unit, it is possible to detect defects in both the surface and the inside of the liquid ejection unit 201. In specific, it is possible to detect defects in both the ejection port surface 205 of the liquid ejection unit 201 and the inside of the liquid circulation channel 203. Moreover, in a case where a defect is detected, it is possible to inhibit a defect such as defective ejection or quality degradation and contamination of the substrate W by appropriately executing the maintenance processing.

Device Manufacturing Method

It is possible to manufacture goods by using the imprint apparatus 1 described above. It is possible to manufacture devices as the goods. A method of manufacturing a device (semiconductor device, liquid crystal display device, and so on) includes a step of forming a pattern on the substrate W (wafer, glass plate, and so on) using the above-described imprint apparatus 1. The device manufacturing method also includes a step of etching the substrate on which the pattern is formed. In a case where other goods such as a patterned medium (storage medium) and an optical element are manufactured, the manufacturing method may include other processing of processing the substrate on which the pattern is formed, instead of the etching. The goods manufacturing method of this embodiment is more advantageous than the conventional methods in at least one of the performance, quality, productivity, and producing cost of the goods.

Other Embodiments

Although there is described an example where the second position 120 of the lighting 105 is a position rotated by about 30° about the liquid ejection unit 201 from the first position 110 in the first embodiment, the configuration is not limited thereto. The second position 120 may be any position at least it is a position where the foreign substance and the like on the ejection port surface 205 can be detected, and it is possible to set the second position at a proper position according to the distance between the liquid ejection unit 201 and the lighting 105 and the illuminance of the lighting 105. Also, the positions for the lighting 105 are not limited to two.

Additionally, although there is described an example where the lighting unit 103 includes the dark-bright field switching mechanism 104 and the lighting 105, and the dark-bright field switching mechanism 104 moves the single lighting 105 to the two positions in the first embodiment, multiple lightings may be provided. For example, it is possible to use a lighting unit that allows lightings 105 to be arranged at the first position 110 and the second position 120, respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-223774, filed Dec. 11, 2019, which is hereby incorporated by reference wherein in its entirety.

What is claimed is:

1. A liquid ejection apparatus, comprising:

a liquid ejection unit configured with an ejection port surface provided with an ejection port from which liquid is ejected;

an imaging unit configured to face the ejection port surface of the liquid ejection unit and to capture an image of the ejection port surface;

a lighting unit configured to irradiate the ejection port surface at a plurality of incidence angles with respect to the ejection port surface; and a control unit configured to determine, based on a first image captured by the imaging unit in a case where the lighting unit irradiates the ejection port surface at a first angle, whether to cause the lighting unit to irradiate the ejection port surface at a second angle different from the first angle and cause the imaging unit to capture a second image.

2. The liquid ejection apparatus according to claim 1, further comprising:

an adjustment mechanism configured to adjust an incidence angle of a light source of the lighting unit with respect to the ejection port surface.

3. The liquid ejection apparatus according to claim 2, wherein the adjustment mechanism is configured to be able to move the light source of the lighting unit to a first position having the first angle and to a second position having the second angle.

4. The liquid ejection apparatus according to claim 1, wherein the lighting unit includes:

a first light source arranged at a first position having the first angle; and a second light source arranged at a second position having the second angle.

5. The liquid ejection apparatus according to claim 1, further comprising:

an examination mechanism configured to examine the liquid ejection unit by using the first image and the second image.

6. The liquid ejection apparatus according to claim 5, wherein the examination mechanism compares an ideal image obtained in advance to the first image and the second image.

7. The liquid ejection apparatus according to claim 5, wherein in a case where the examination mechanism determines that the liquid ejection unit is abnormal based on the first image, the control unit performs a first maintenance where the liquid is forcibly discharged from the liquid ejection unit.

8. The liquid ejection apparatus according to claim 7, wherein after the first maintenance, the control unit performs a second maintenance including vacuuming and wiping on the ejection port surface of the liquid ejection unit.

9. The liquid ejection apparatus according to claim 5, wherein in a case where the examination mechanism determines that the liquid ejection unit is abnormal based on the second image, the control unit performs a second maintenance including vacuuming and wiping on the ejection port surface of the liquid ejection unit.

10. The liquid ejection apparatus according to claim 1, wherein the lighting unit further includes a dimmer mechanism configured to dim lighting.

11. The liquid ejection apparatus according to claim 1, wherein a bright field observation is performed at the first angle and a dark field observation is performed at the second angle.

12. The liquid ejection apparatus according to claim 1, further comprising a substrate stage configured to move the substrate with respect to the ejection portion, wherein the liquid ejection unit ejects the liquid onto the substrate at an ejection position.

13. A liquid ejection apparatus, comprising:

a liquid ejection unit configured with an ejection port surface provided with an ejection port from which liquid is ejected;

an imaging unit configured to face the ejection port surface of the liquid ejection unit and to capture an image of the ejection port surface;

a lighting unit configured to irradiate the ejection port surface at a plurality of incidence angles with respect to the ejection port surface; and a control unit configured to change maintenance of the liquid ejection unit according to a first image captured by the imaging unit in a case where the lighting unit irradiates the ejection port surface at a first angle and a second image captured by the imaging unit in a case where the lighting unit irradiates the ejection port surface at a second angle different from the first angle.

14. The liquid ejection apparatus according to claim 13, wherein in a case where the liquid ejection unit is determined abnormal based on the first image, the control unit performs at least a first maintenance where the liquid is forcibly discharged from the liquid ejection unit.

15. The liquid ejection apparatus according to claim 14, wherein after the first maintenance, the control unit performs a second maintenance including vacuuming and wiping on the ejection port surface of the liquid ejection unit.

16. The liquid ejection apparatus according to claim 15, wherein in a case that the liquid ejection unit is determined abnormal based on the second image, the control unit performs a second maintenance including vacuuming and wiping on the ejection port surface of the liquid ejection unit.

17. The liquid ejection apparatus according to claim 13, wherein a bright field observation is performed at the first angle and a dark field observation is performed at the second angle.

18. A method of operating a liquid ejection apparatus, the liquid ejection apparatus comprising a liquid ejection unit configured with an ejection port surface provided with an ejection port from which liquid is ejected, an imaging unit configured to face the ejection port surface of the liquid ejection unit and to capture an image of the ejection port surface, a lighting unit configured to irradiate the ejection port surface at a plurality of incidence angles with respect to the ejection port surface, and a control unit, the method comprising:

irradiating the ejection port surface at a first angle by the lighting unit;

capturing a first image of the ejection port surface by the imaging unit; and determining by the control unit, based on the first image, whether to cause the lighting unit to irradiate the ejection port surface at a second angle different from the first angle and cause the imaging unit to capture a second image.

19. The method according to claim 18, further comprising:

capturing the second image; and examining the liquid ejection unit by using the first image and the second image.

20. The method according to claim 19, further comprising comparing an ideal image obtained in advance to the first image and the second image.

21. The method according to claim 19, further comprising performing a first maintenance where the liquid is forcibly discharged from the liquid ejection unit in a case where a determination is made that the liquid ejection unit is abnormal based on the first image.

22. The method according to claim 21, further comprising performing, after the first maintenance, a second maintenance including vacuuming and wiping on the ejection port surface of the liquid ejection unit.

23. The method according to claim 19, further comprising performing a second maintenance including vacuuming and wiping on the ejection port surface of the liquid ejection unit in a case where a determination is made that the liquid ejection unit is abnormal based on the second image.

* * * * *